US007640601B2

(12) United States Patent
Lee

(10) Patent No.: US 7,640,601 B2
(45) Date of Patent: Jan. 5, 2010

(54) SPORTS CAP

(75) Inventor: Lien-Hsin Lee, Luchou (TW)

(73) Assignee: Moldtek Precision Corp, Taipei (TW)

( * ) Notice: Subject to any disclaimer, the term of this patent is extended or adjusted under 35 U.S.C. 154(b) by 0 days.

(21) Appl. No.: 11/690,858

(22) Filed: Mar. 26, 2007

(65) Prior Publication Data

US 2009/0288239 A1 Nov. 26, 2009

(51) Int. Cl.
*A42B 1/24* (2006.01)

(52) U.S. Cl. ..... 2/209.13; 2/209.12; 2/195.1; 2/195.6

(58) Field of Classification Search ..... 2/171, 2/175.1, 175.4, 175.5, 195.1, 195.5, 195.6, 2/209.12, 209.13; 24/90.1, 93, 94, 101 R, 24/303; 473/406
See application file for complete search history.

(56) References Cited

U.S. PATENT DOCUMENTS 3,462,862 A * 8/1969 Chase ..... 40/1.5
5,351,949 A * 10/1994 Fox et al. ..... 473/285
5,996,116 A * 12/1999 Tate ..... 2/12
6,163,889 A * 12/2000 Tate ..... 2/209.13
6,170,088 B1 * 1/2001 Tate ..... 2/209.13
6,457,184 B1 * 10/2002 Adams ..... 2/209.13
2004/0117894 A1 * 6/2004 Kuo ..... 2/209.13

* cited by examiner

*Primary Examiner*—Gary L Welch
*Assistant Examiner*—Sally Colson Cline
(74) *Attorney, Agent, or Firm*—Bacon & Thomas, PLLC

(57) ABSTRACT

A sports cap in which a visor has an intermediate support layer bonded with a bottom lining layer and sandwiched between a top layer and a bottom layer, and a positioning block with a center insertion hole selectively fastened to one of recesses on the top side of the intermediate support layer for securing a stem of a decorative item for enabling a golf counter to be detachably fastened to the decorative item by means of magnetic attraction.

5 Claims, 6 Drawing Sheets

SPORTS CAP

BACKGROUND OF THE INVENTION

1. Field of the Invention

The present invention relates to the sports caps and more particularly to the design of the visor of a sports cap that allows installation of decorative items and a golf counter.

2. Description of the Related Art

To modern people, enjoying the sunlight and the stunning beauty of the lush green fields is one of the best ways to release stress. Therefore, outdoor sports games are widely participated. In recent years, with the prosperity of the society and the fast growing of the industries and business, the sports population has significantly increased. Whether male or female, old or young, people enjoy sports and encourage their friends and relatives to join.

When playing an outdoor sports game in the wild open field, the body is exposed to the radiation of the sunlight. Therefore, it is necessary to wear a cap, protecting the head and the eyes from the radiation of the sunlight. Under the protection of the cap, the user can enjoy the sports game more comfortably.

However, a regular sports cap is simply a covering with a visor for protecting the user's head and eyes from the radiation of the sunlight. Modern people's requirements for products are critical. In addition to functions, people do care about quality, beauty, novelty and unique characteristic. To flourish in the market, a sports cap manufacturer needs to create unique and innovative sports caps with added features to attract consumers.

SUMMARY OF THE INVENTION

The present invention has been accomplished under the circumstances in view. Therefore one object of the present invention is to provide a sports cap that allows installation of decorative items and a detachable golf counter in the visor.

According to one aspect of the present invention, the sports cap comprises a crown and a visor extending outward from the bottom edge of the crown. The visor comprises an intermediate support layer that supports the visor in shape and has multiple recesses on the top side, a top layer covering the intermediate support layer, a positioning block fitted into one recess of the intermediate support layer, the positioning block with a center insertion hole for receiving a stem of a decorative item, a bottom layer covering the bottom side of the intermediate support layer opposite to the top layer, and a lining layer sandwiched between the intermediate support layer and the bottom layer.

According to another aspect of the present invention, a hold down member is fastened to one recess of the intermediate support layer to hold the positioning block in place. The hold down member has a center through hole axially aligned with the center insertion hole of the positioning block, a group of first mounting legs for securing the positioning block, and a group of second mounting legs for fastening to the associated recess of the intermediate support layer.

According to another aspect of the present invention, a golf counter can be attached to the decorative item at the visor and secured thereto by means of magnetic force.

DETAILED DESCRIPTION OF THE PREFERRED EMBODIMENT

Figure 1:
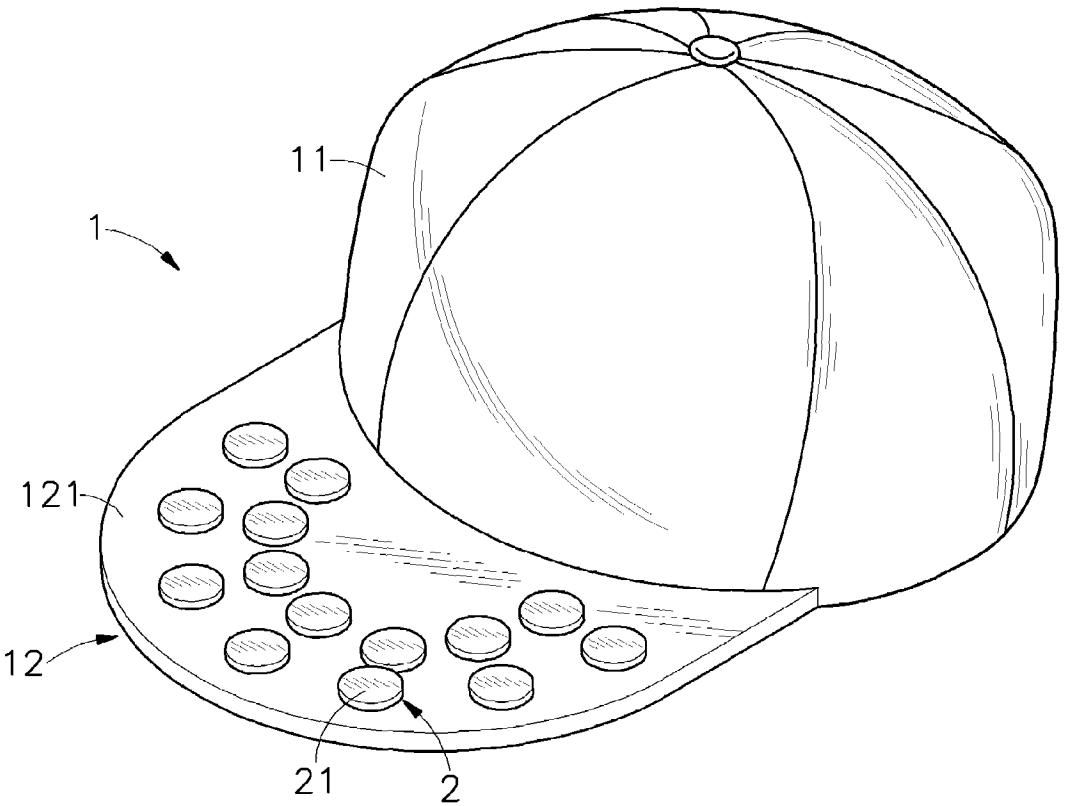
FIG. 1 is an elevational view of a sports cap in accordance with a first embodiment of the present invention.
Figure 2:
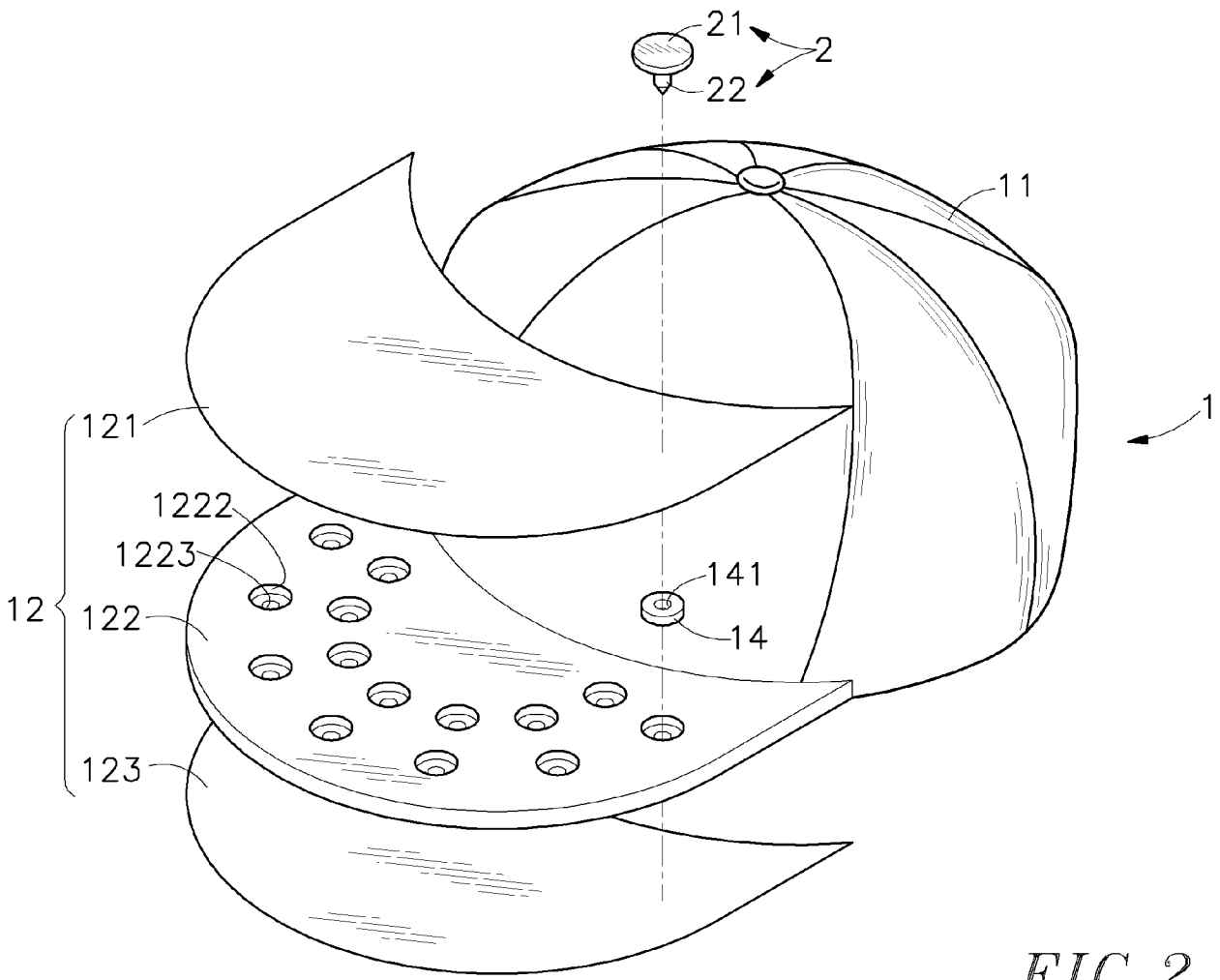
FIG. 2 is an exploded view of the sports cap according to the first embodiment of the present invention.

Referring to FIGS. 1 and 2, a sports cap 1 is shown comprising a crown 11 for covering the user's head and a visor 12 extending outward from a part of the crown 11.

The visor 12 is comprised of a top layer 121, an intermediate support layer 122 and a bottom layer 123. The intermediate support layer 122 is sandwiched between the top layer 121 and the bottom layer 123 to support the visor 12 in shape, having multiple recesses 1222 on the top side and spaced from one another at a distance, a positioning hole 1223 in each recess 122, and a positioning block 14 fitted into each recess 1222. The positioning block 14 has a center insertion hole 141 axially aligned with the positioning hole 1223 in the associated recess 1222, and is adapted to attract a decorative item 2 by means of magnetic attraction, i.e., the decorative item 2 and the positioning block 14 are made out of a ferrous or magnetic material. The decorative item 2 comprises a head 21 and at least one stem 22 extended from the bottom side of the head 21. The head 21 can be made having a circular or rectangular profile, or the geographical shape of a country, or the shape of a character. The stem 22 according to this embodiment is a round rod. Further, the stem 22 is pierced through the top layer 121 and then fitted into the center insertion hole 141 of the positioning block 14 and the positioning hole 1223 in the associated recess 1222 to secure the decorative item 2 to the visor 12, keeping the head 21 supported on the top side of the top layer 121 (see FIG. 1).

Figure 3:
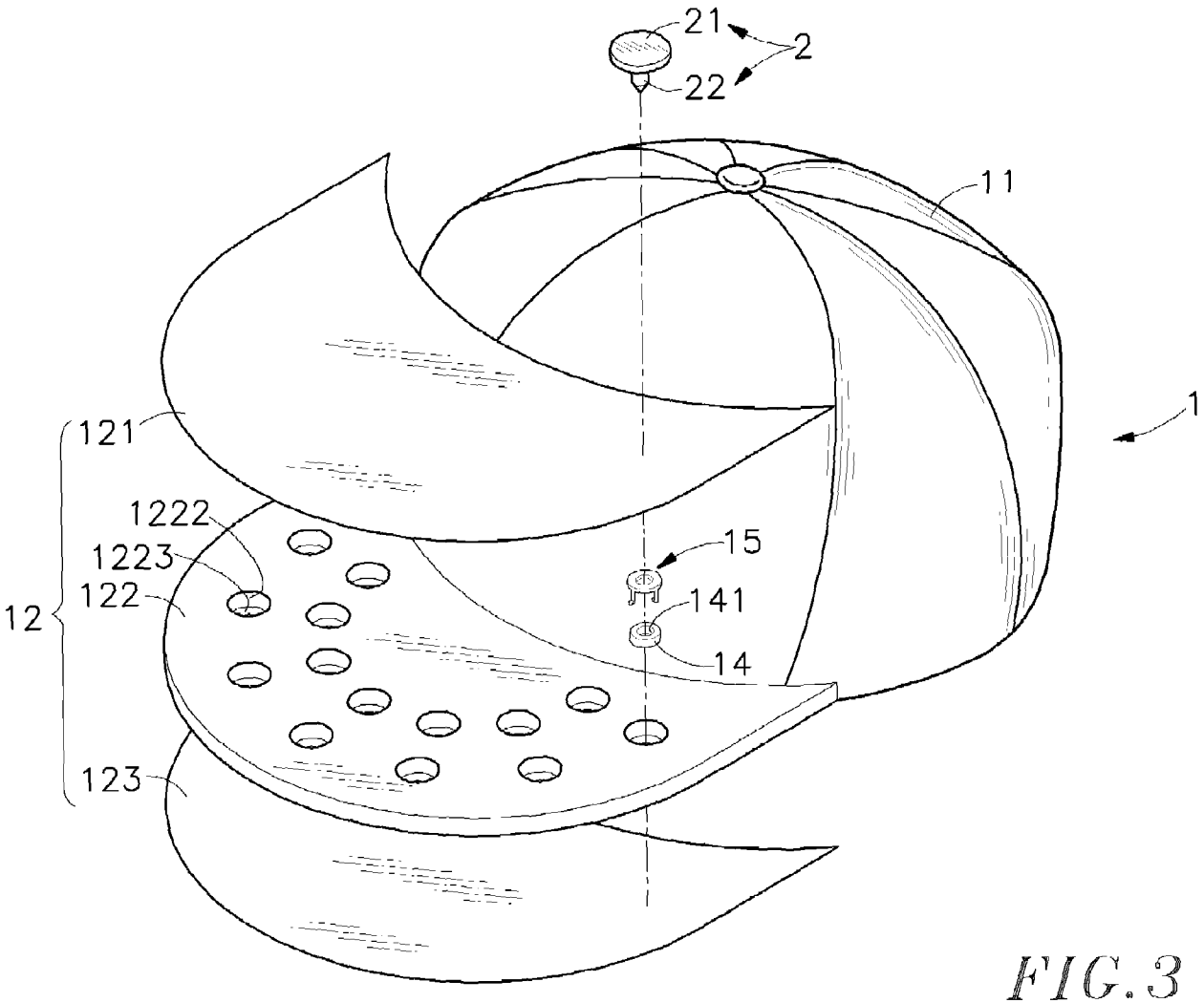
FIG. 3 is an exploded view of a sports cap in accordance with a second embodiment of the present invention.
Figure 4:
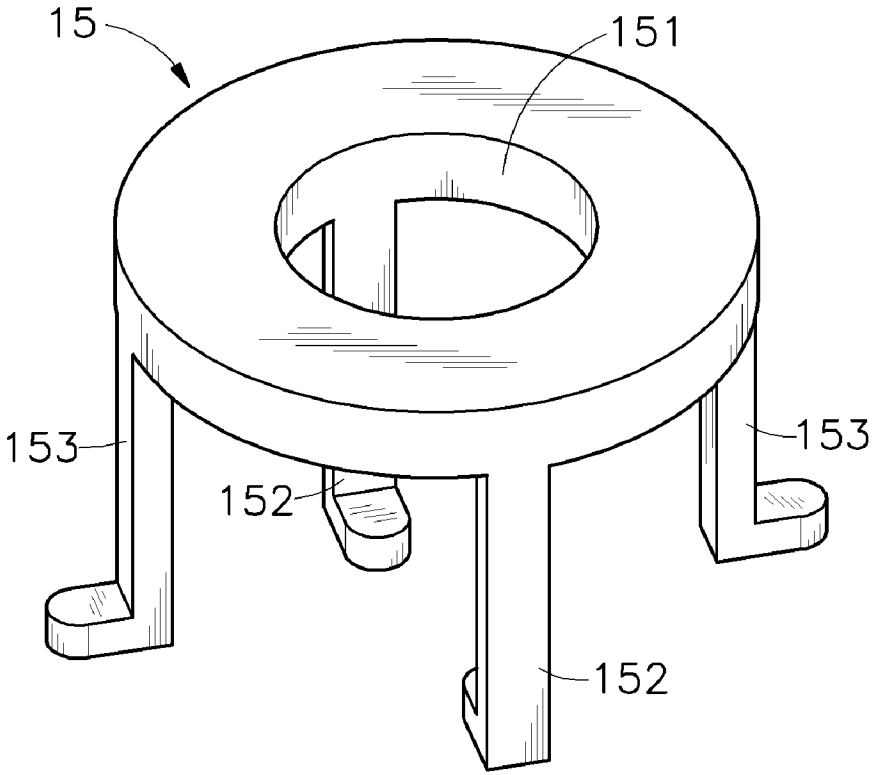
FIG. 4 is an enlarged view of the hold down member shown in FIG. 3.

Referring to FIGS. 3 and 4 are an exploded view of a sports cap and an enlarged view of a hold down member in accordance with a second embodiment of the present invention. According to this embodiment, a hold down member 15 is mounted in one recess 1222 of the intermediate support layer 122 to hold down the positioning block 14. The hold down member 15 has a center through hole 151 for the passing of the stem 22 of the decorative item 2, a group of first mounting legs 152 adapted to secure the positioning block 14, and a group of second mounting legs 153 for fastening to the recess 1222.

Figure 5:
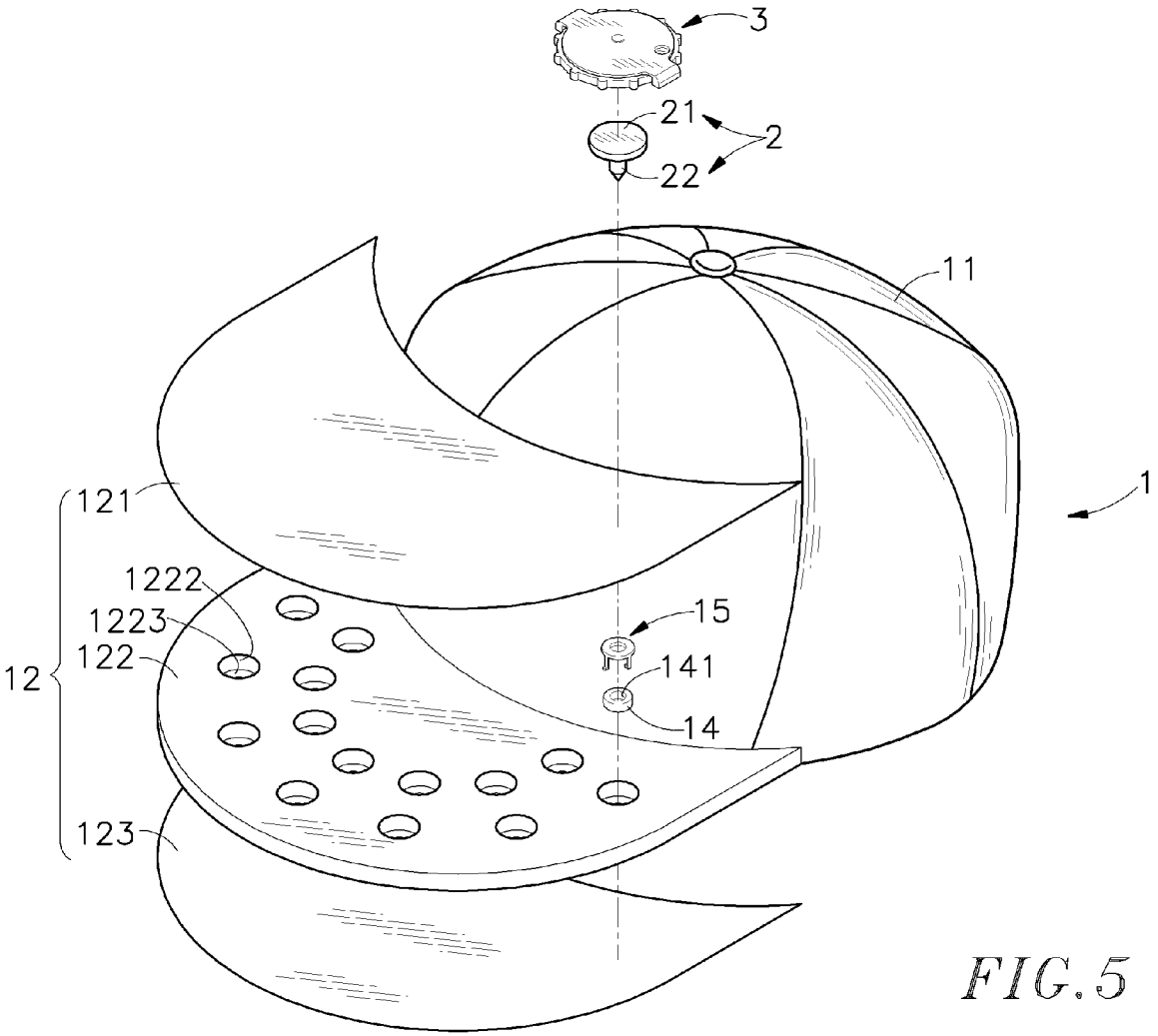
FIG. 5 corresponds to FIG. 3, showing a golf counter used with the sports cap.

Referring to FIG. 5, the decorative item 2 can be made out of a magnetic material so that a golf counter 3 can be attached to the head 21 of the decorative item 2 and secured thereto by means of magnetic attraction.

Figure 6:
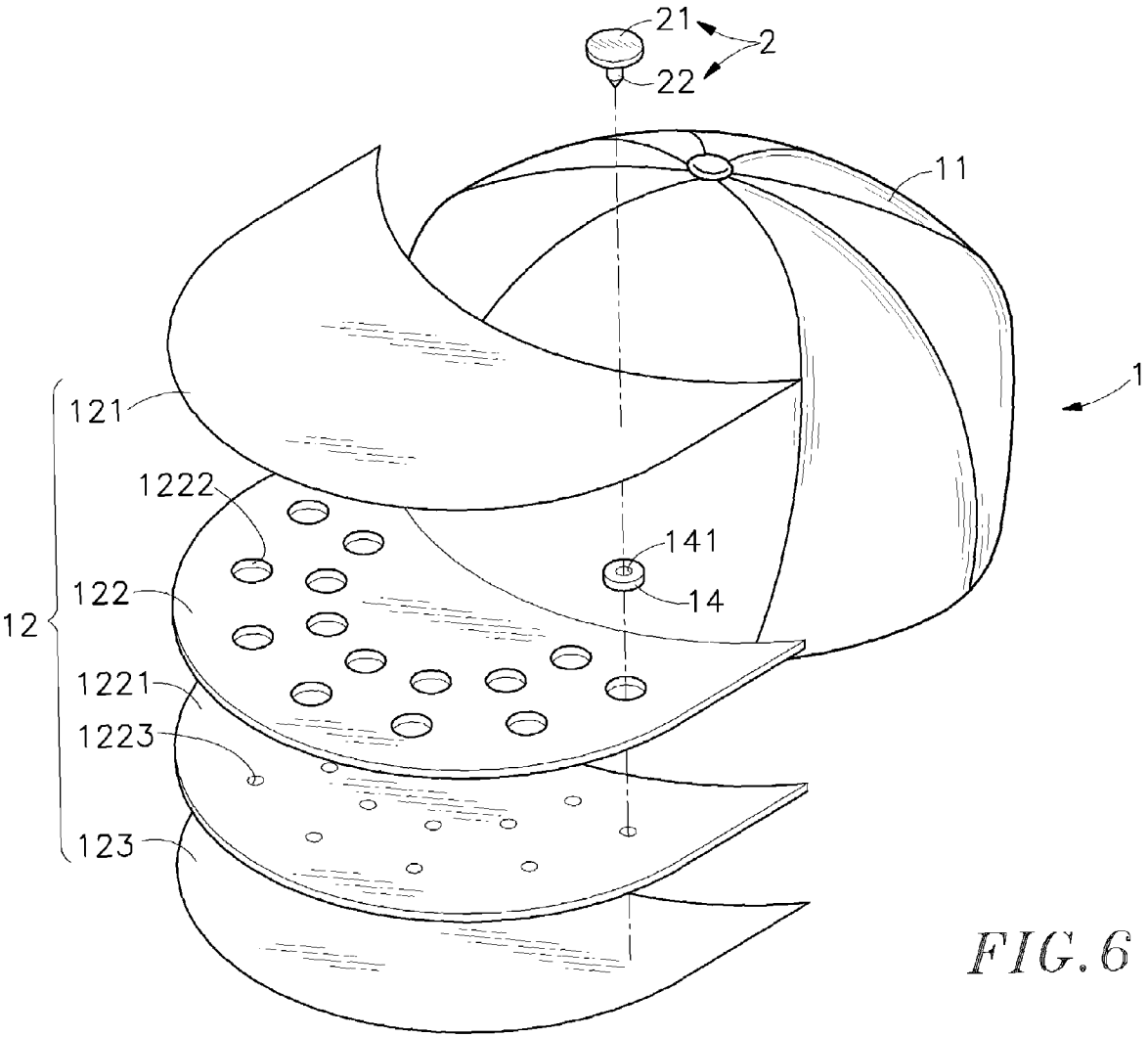
FIG. 6 is an exploded view of a sports cap in accordance with a third embodiment of the present invention.

FIG. 6 is an exploded view of a sports cap in accordance with a third embodiment of the present invention. According to this embodiment, the visor 12 is comprised of a top layer 121, an intermediate support layer 122, a lining layer 1221 and a bottom layer 123. The intermediate support layer 122 is sandwiched between the top layer 121 and the bottom layer 123 to support the visor 12 in shape, having multiple recesses 1222 on the top side and a positioning block 14 fitted into each recess 1222. The positioning block 14 has a center insertion hole 141. The lining layer 1221 is bonded to the bottom side of the intermediate support layer 122 and sandwiched between the intermediate support layer 122 and the bottom layer 123, having a group of positioning holes 1223 axially aligned with the center insertion hole 141 of the positioning block 14 in the associating recess 1222.

In general, the invention provides a sports cap that has the following advantages:

1. The visor 12 of the sports cap 1 allows for installation of decorative items 2 securely. The decorative items 2 decorate the visor 12 of the sports cap 1. Further, a golf counter 3 can be secured to one decorative item 2 at the visor 12 of the sports cap 1 by means of magnetic attraction, adding an additional function to the sports cap 1.

2. By means of a series of designs on the visor 12, the invention provides different models of sports caps to satisfy different needs from different users.

Although a particular embodiment of the invention has been described in detail for purposes of illustration, various modifications and enhancements may be made without departing from the spirit and scope of the invention. For example, the decorative item can be made having a head and multiple spring legs that can be inserted through the visor and then bent into shape to secure the head to the visor. Accordingly, the invention is not to be limited except as by the appended claims.

What the invention claimed is:

1. A sports cap having a crown and a visor extending outward from the bottom edge of the crown, wherein the visor comprises:

an intermediate support layer that maintains the visor in shape, the intermediate support layer having a top side, a bottom side, multiple recesses on the top side, a top layer covering the top side of the intermediate support layer;

a positioning block fitted into one recess of the intermediate support layer, the positioning block having a center insertion hole, a bottom layer covering the bottom side of the intermediate support layer opposite to the top layer;

a lining layer sandwiched between the intermediate support layer and the bottom layer; and a hold down member fitted into one recess of the intermediate support layer to hold down the positioning block, the hold down member having a center through hole in axial alignment with the center insertion hole of the positioning block, a group of first mounting legs that secure the positioning block, and a group of second mounting legs fastened to an associating recess of the intermediate support layer.

2. The sports cap as claimed in claim 1, further comprising a decorative item fastened to the visor, the decorative item having a head supported above the top layer and at least one stem extending from the head and inserted through the top layer into the center insertion hole of the positioning block in one recess of the intermediate support layer.

3. The sports cap as claimed in claim 2, wherein the decorative item and the positioning block are respectively made out of a magnetic material and a ferrous material.

4. The sports cap as claimed in claim 2, wherein the head of each of the at least one decorative item is a magnetic member for securing a golf counter by means of magnetic attraction.

5. The sports cap as claimed in claim 1, wherein the intermediate support layer has a positioning hole in each of the recesses for the location of the stem of a decorative item.

* * * * *